United States Patent [19]

Lindtveit

[11] 4,276,871

[45] Jul. 7, 1981

[54] FLUE DAMPER AND DRAFT REGULATOR

[75] Inventor: Herbert Lindtveit, West Hempstead, N.Y.

[73] Assignee: Sid Harvey, Inc., Valley Stream, N.Y.

[21] Appl. No.: 93,057

[22] Filed: Nov. 13, 1979

[51] Int. Cl.[3] ..... F23L 3/00

[52] U.S. Cl. ..... 126/292; 126/312; 236/45

[58] Field of Search ..... 126/307 A, 312, 285 A, 126/288, 293, 289, 292; 98/117; 236/45

[56] References Cited

U.S. PATENT DOCUMENTS

| | | | |
|---|---|---|---|
| 1,773,585 | 8/1930 | Klockau | 236/45 |
| 1,833,888 | 12/1931 | Barker | 236/45 |
| 2,113,440 | 4/1938 | Cole | 236/45 |
| 2,164,607 | 7/1939 | Cole | 236/45 |
| 2,296,410 | 9/1942 | Wetzsteon | 236/45 |
| 2,319,652 | 5/1943 | Young | 236/45 |

*Primary Examiner*—James C. Yeung

*Attorney, Agent, or Firm*—Cooper, Dunham, Clark, Griffin & Moran

[57] ABSTRACT

A flue damper and draft regulator for a furnace in which the orientation of the damper is controlled by a vane. One face of the vane is subject to external atmospheric pressure. The other face of the vane is subject to the flue pressure both upstream and downstream from the damper. Exposing the vane to the reduced pressure on the chimney side provides a force which closes the damper when the burner shuts off.

7 Claims, 4 Drawing Figures

FLUE DAMPER AND DRAFT REGULATOR

BACKGROUND OF THE INVENTION

This invention relates to a heat conserving damper control which regulates the draft within the flue when the furnace is operating and which closes the flue to reduce heat loss when the furnace shuts off.

Flue damper controls are devices designed to conserve heating fuel. Optimally, these devices adjust the draft in the flue when the burner is on and close the flue to retard the loss of heat when the burner goes off. The need for fuel-saving devices of this nature is apparent in times of fuel shortages and rising fuel prices.

Many damper controls have been described in the prior art. Most of these devices consist of dampers which are opened and closed in response to a room thermostat. For example, U.S. Pat. No. 1,773,585 to Klockau discloses a damper subject to flue pressure on one side and atmospheric pressure on the other. When the room thermostat calls for heat, an electromagnet drives the damper open against the influence of a counterweight. While the furnace is operating, the damper can float through a limited range of positions to regulate the draft within the flue. When the thermostat shuts off the furnace, the circuit is broken and the weight swings the damper closed, preventing the loss of heat. Similar power-assisted dampers are described in U.S. Pat. Nos. 1,833,888 to Barker and 2,319,652 to Young.

In U.S. Pat. No. 2,113,440 to Cole, a damper control is disclosed which utilizes a pressure-responsive mechanism separate from the damper to control the attitude of the damper. In this patent, a vane, subject to external atmospheric pressure on one side and to the pressure in the flue upstream from the damper on its other side, is connected to the damper and regulates the draft inside the flue. This damper control, like the other prior art devices, employs a motor controlled by a thermostat to drive the damper to its closed position when the burner shuts down.

It is therefore an object of the present invention to provide a damper control for a furnace which operates solely in response to external atmospheric pressure and to flue pressure.

It is a related object to provide a damper control for a furnace which regulates the draft in the flue when the furnace is on and closes the damper when the furnace turns off, all without assistance from an external power source.

It is another object of the present invention to provide a damper control for furnaces which is simple, inexpensive, and easily installed on existing smoke pipes.

SUMMARY OF THE INVENTION

These and other objects are accomplished by means of the present invention which provides a flue damper for a furnace comprising a smoke pipe, a damper inside the smoke pipe operable between open and closed positions, a vane subject to external atmospheric pressure on one face and to both upstream and downstream flue pressure on its other face, and means connecting the vane to the damper and acting in a direction to close the damper when the atmospheric pressure exceeds the pressure of the flue gases on the vane. By exposing the vane to the flue pressure downstream from the damper, the damper is influenced to close and remain closed when the burner shuts down. Thus, the present invention provides a positive closing action for the damper without assistance from an external power source when the burner shuts off.

DETAILED DESCRIPTION

Figure 1:
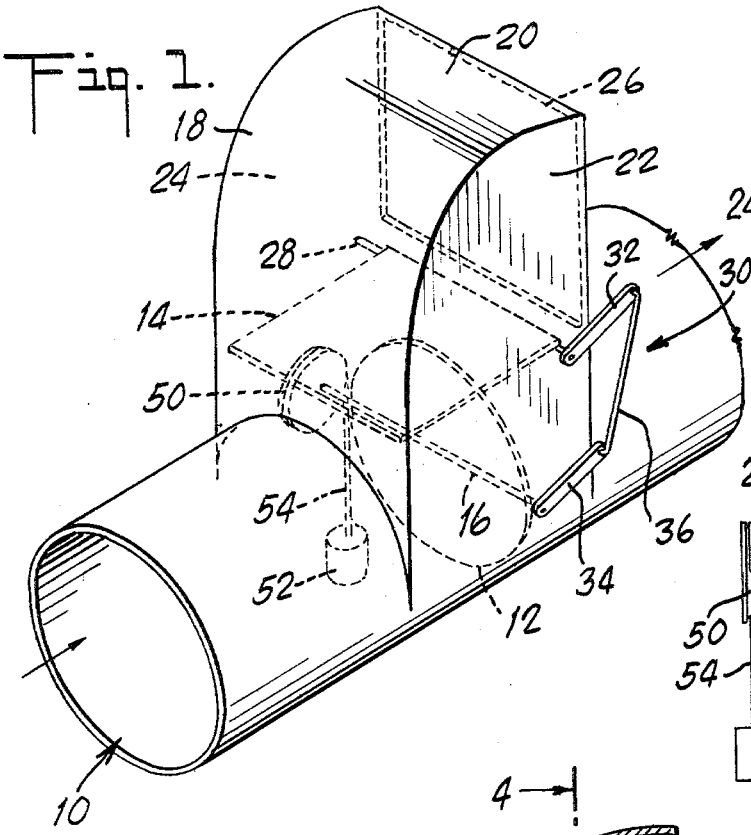
FIG. 1 is a perspective view showing some of the inner parts of an embodiment of the invention.
Figure 2:
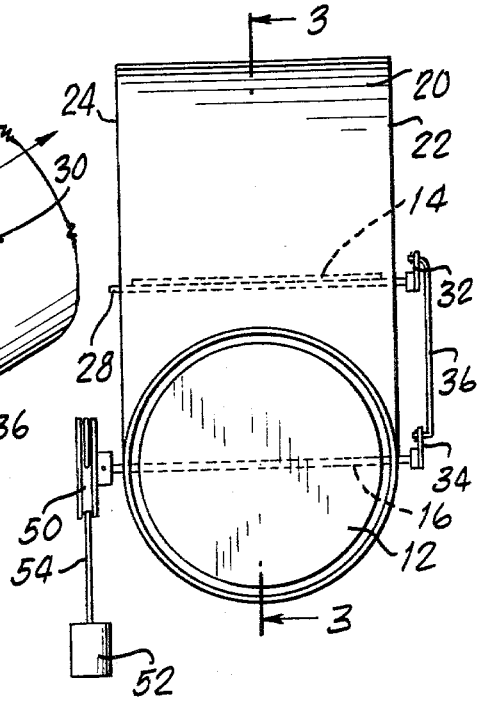
FIG. 2 is a view from the upstream or furnace side of the device showing the damper in the closed position.

The illustrated embodiment of the invention comprises a smoke pipe 10, a damper 12 which fits snugly inside the smoke pipe, and a vane 14. Damper 12 is a flat, circular plate mounted for rotation on damper shaft 16. The damper divides smoke pipe 10 into an upstream or furnace side 6 and a downstream or chimney side 8.

Damper shaft 16 lies in the same horizontal plane as and at right angles to the axis of smoke pipe 10. By rotating shaft 16, damper 12 may be tilted into an angular position with respect to the axis of smoke pipe 10. It may thus be seen that damper 12 operates between a closed position, which obstructs the flow of flue gases, and an open position, which permits the flow of said gases. As damper 12 is inherently balanced in all angular positions, the pressure of the flue gases on the damper plays no part in its orientation.

The orientation of damper 12 inside smoke pipe 10 is controlled by vane 14. Vane 14 is housed within casing 18 which is mounted atop smoke pipe 10. Casing 18 is provided with an arcuate outer wall 20 and segmental side walls 22 and 24. The right hand side of casing 18 as viewed in FIG. 3, has a shoulder 25 and an upper portion 26 left open to the atmosphere.

Vane 14 has upper and lower faces 27 and 29. Vane 14 is pivotally mounted on vane shaft 28. The vane fits closely between side walls 22 and 24 of the casing and also moves close to outer wall 20 when vane shaft 28 is rotated. The dimensions of vane 14 are such that the edges of the vane just clear the various walls of casing 18 at all positions of the vane.

The rotational motion of vane 14 is transmitted to damper 12 by means of a linkage, generally designated as 30. The linkage illustrated comprises lever 32 attached to vane shaft 28, lever 34 attached to damper shaft 16, and link 36 which connects the two levers to each other. When vane 14 swings upward as illustrated, the linkage transmits the rotation of the vane to the damper and the damper is driven open. Other linkages capable of transmitting the rotary motion of vane 14 of damper 12 will also be effective and the present invention is not limited to the linkage illustrated.

Figure 3:
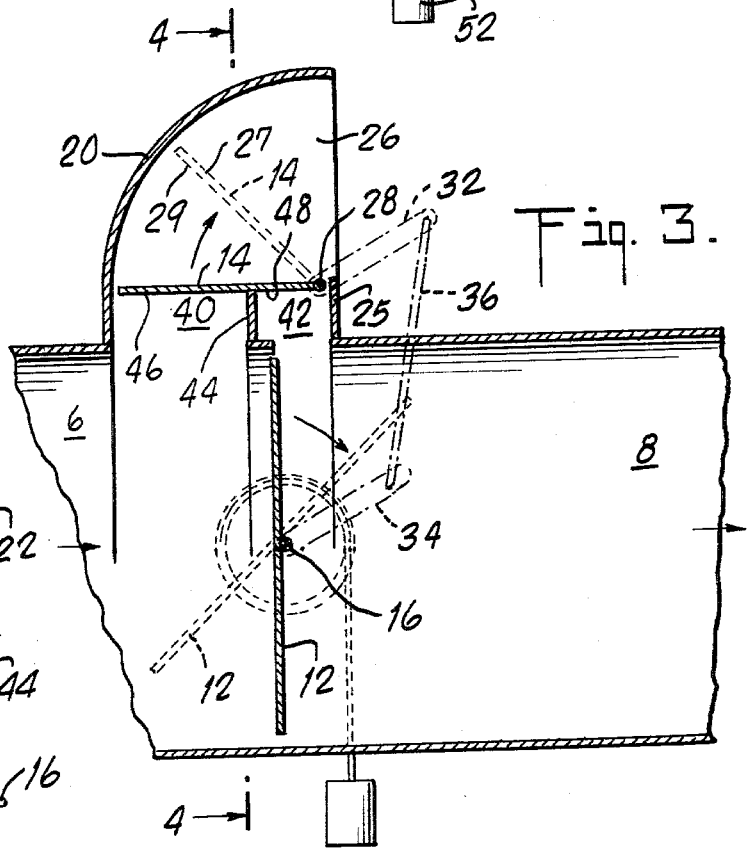
FIG. 3 is a sectional view taken along line 3—3 of FIG. 2 showing the damper in full lines in its closed position and in dotted lines in a partially open position.
Figure 4:
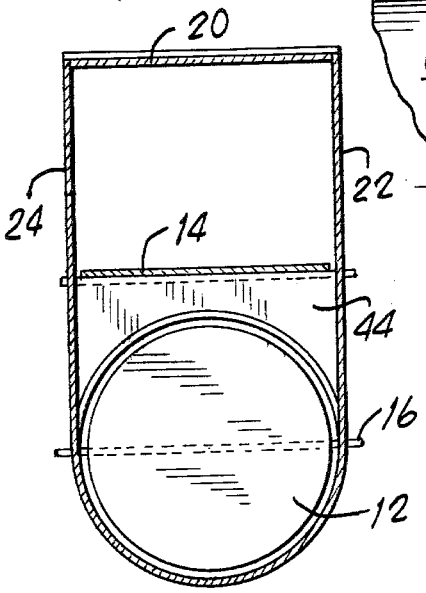
FIG. 4 is a sectional view taken along line 4—4 of FIG. 3 showing the damper in the closed position.

As can be seen in FIG. 3, casing 18 communicates with smoke pipe 10 through a duct 40 located upstream of damper 12 and through a duct 42 located downstream of the damper. The two ducts are separated by a partition or barrier, designated 44 in the illustrations. When vane 14 is fully down, it rests atop partition 44 and prevents convergence of the upstream and downstream gases.

As can readily be comprehended from FIG. 3, the upper surface of vane 14 is exposed to atmospheric pressure through opening 26 and the lower surface is subject to both the upstream and downstream pressures of the flue gases. The entire lower surface of the vane is exposed to both the upstream and downstream pressures through ducts 40 and 42 when vane 14 is up. When vane 14 is fully down and rests against partition 44, however, a portion of the lower surface, designated 46, is exposed to the upstream pressure only, while the remainder of the lower surface, designated 48, is exposed only to downstream pressure.

Unlike the device of U.S. Pat. No. 2,113,440, the vane of the present invention remains under the influence of the chimney when the damper is closed. The draft from the chimney acting on portion 48 of the vane helps force the damper closed when the burner shuts off. The suction also minimizes leakage by keeping the vane down and the damper closed.

Properly counterbalanced, the damper control regulates the draft within the flue when the burner is on and closes the smoke pipe to prevent heat loss when the burner is shut off. A pulley 50 is attached to one end of damper shaft 16 and a weight 52 is suspended from the pulley by means of a cord or chain 54. Weight 52 biases the damper towards an open position. By selecting the proper weight, any desired draft can be obtained when the furnace is on.

In operation, the heat from the flame produces a slight pressure on the upstream section 46 of vane 14 when the burner starts up. This pressure, with the help of the draft setting weight 52, pushes the vane upward against the influence of atmospheric pressure and the suction in the downstream side of the smoke pipe. The vane thereby drives the damper wide open allowing the flue gases to pass through.

As the burner continues to operate and the draft from the chimney increases, the flue pressure decreases so that the atmospheric pressure starts to push the vane downward. The vane partially closes the damper and reduces the draft. When the subatmospheric pressure in the smoke pipe reaches a value determined by weight 50, the vane movement stops. If the draft decreases, the weight urges the damper further open. The throttling effect of the damper then becomes sufficiently reduced to allow more flue gas to pass through the smoke pipe, thereby reestablishing the desired degree of draft. Similarly, if the draft increases, the flue pressure decreases and the atmospheric pressure urges the damper closed. In this manner, the draft in the smoke pipe is maintained constant and is automatically adjusted when the burner is on.

When the burner shuts down, the movement of hot gases through the flue pipe rapidly diminishes. Atmospheric pressure pushes the vane downward. As the vane approaches partition 44, the suction from the chimney side begins to affect the downstream section 48 of the vane through duct 42. When the vane comes close to partition 44, this suction provides an additional force which closes the vane and the damper without assistance from any external source of power. The suction from the chimney also holds the vane down and the damper closed, thus minimizing leakage, while the burner is off.

Units embodying the present invention have been constructed and installed on existing smoke pipes. In these units, the area of the vane is equal to about one half to two-thirds the cross-sectional area of the flue pipe, and the upstream section 46 of the vane is about twice the size of the downstream section 48. The proportion of the area of the vane to the cross-sectional area of the flue pipe, and the proportion of the area of the upstream section 46 to the area of the downstream section 48, are not critical, but may be varied over a substantial range. These units have proven successful in helping to conserve fuel by regulating the draft in the flue when the burner is on and by shutting the flue when the burner goes off.

While the present invention has been described by reference to a specific embodiment, it should be understood that this description is merely illustrative. Many changes in the details of construction and the combination and arrangement of parts may be made without departing from the spirit or scope of the present invention.

I claim:

1. A draft regulator for a furnace, comprising:

(a) a smoke pipe;

(b) a damper in the smoke pipe operable between open and closed positions;

(c) a shaft supporting the damper in the smoke pipe;

(d) a casing in fluid communication with said smoke pipe;

(e) a movable vane within said casing, said vane having an outer face and an inner face, the outer face being subject to atmospheric pressure outside the smoke pipe, the inner face being subject to the pressure inside the smoke pipe;

(f) means supporting the vane for movement within the casing;

(g) a partition separating a portion of the casing into an upstream duct communicating with the smoke pipe upstream from the damper and a downstream duct communicating with the smoke pipe downstream from the damper, said partition serving as an abutment to engage the vane when the damper is in the closed position, so that a portion of the inner face of the vane is then subject to the upstream pressure and another portion is subject to the downstream pressure; and (h) means connecting the vane to the damper for concurrent movement, said vane acting in a direction to close the damper when the atmospheric pressure exceeds the pressure inside the smoke pipe.

2. A draft regulator as described in claim 1, further comprising:

means biasing the vane and the damper toward the damper open position, said biasing means and said vane cooperating to determine the position of the damper.

3. A draft regulator as described in claim 1, wherein one portion of the inner face of the vane is subject only to the upstream pressure and the remainder of the inner face is subject only to the downstream pressure when the damper is in the closed position.

4. A draft regulator as described in claim 1, wherein the damper is a butterfly valve.

5. A draft regulator as in claim 1, wherein said means supporting the vane for movement comprises pivot means supporting the vane for rotational movement.

6. A draft regulator as in claim 1, wherein said means connecting the vane to the damper comprises linkage means.

7. A draft regulator as in claim 2, wherein said biasing means comprises weight means.

* * * * *